United States Patent [19]

Wang

[11] Patent Number: 4,681,141

[45] Date of Patent: Jul. 21, 1987

[54] LIGHT-DETECTOR, HAND-CONTROLLED FAUCET WITH WATER TEMPERATURE REGULATOR

[76] Inventor: Wen-Ching Wang, Room 10-12, No. 2, Fu Hsin N. Rd., Taipei, Taiwan

[21] Appl. No.: 825,434

[22] Filed: Feb. 3, 1986

[51] Int. Cl.[4] ..... F16K 11/07; F16K 31/11; F16K 31/528

[52] U.S. Cl. ..... 137/607; 4/623; 137/625.4; 251/129.03; 251/252

[58] Field of Search ..... 137/625.4, 607, 625.17; 251/129.03, 252; 4/194, 623

[56] References Cited

U.S. PATENT DOCUMENTS

| | | | |
|---|---|---|---|
| 839,953 | 1/1907 | Race | 251/252 |
| 2,043,194 | 6/1936 | Eggleston | 251/129.03 X |
| 2,872,116 | 2/1959 | Kozel et al. | 137/625.4 X |
| 2,996,082 | 8/1961 | Miner | 137/625.4 |
| 3,151,340 | 10/1964 | Teshima | 4/623 X |
| 4,033,370 | 7/1977 | Egli | 137/625.17 X |
| 4,141,383 | 2/1979 | Geimer | 251/129.03 X |
| 4,402,095 | 9/1983 | Pepper | 4/623 |
| 4,493,343 | 1/1985 | Arnold et al. | 137/625.17 |

*Primary Examiner*—Martin P. Schwadron
*Assistant Examiner*—Stephen M. Hepperle
*Attorney, Agent, or Firm*—Asian Pacific Internat Patent & Trademark Office

[57] ABSTRACT

A faucet which uses a light detector to control the faucet as a matter of convenience and for conserving water, and which uses a manual control at power failure when the light detector is not operative so that a supply of water is available at any time from the faucet.

5 Claims, 6 Drawing Figures

LIGHT-DETECTOR, HAND-CONTROLLED FAUCET WITH WATER TEMPERATURE REGULATOR

BACKGROUND OF THE INVENTION

With the advance of science, the standard of living is improving. Development of improved domestic water supply and associated hardware shows the progress achieved in the standard of living. However, the conventional city water system is using hand controlled faucets. Though these may be convenient, they must be closed by hand after use, and thus dirt and/or bacteria on the faucet will again be transferred to the hands just cleaned.

Also, use of a manually controlled faucet is not always convenient enough. Parts may be subjected to wear and damage easily due to frequent turning of its bolt, and damage of leak-proofing components causes water to leak. In view of the aforesaid defects, a light-detector controlled faucet has been invented. Detection of any article or hand below such faucet will open and close the faucet automatically and thus leaving of dirt or bacteria on the hand is prevented. However, this faucet can function only when power is available. Any power failure will preclude an elective water supply, and more inconvenience exists.

Accordingly, I have created a light-detector/hand-controlled faucet which permits manual operation of the faucet at times of power failure to activate the faucet by way of the light-detector.

Furthermore, the present invention includes a device to control the temperature of out flowing water, so that it can provide water of any desired temperature, or selectively cool and hot water alone.

The light-detector hand-controlled faucet with water temperature regulator is described below with reference to the attached drawings.

SUMMARY OF THE INVENTION

The present invention provide a water faucet, particularly a light-detector hand-controlled faucet with water temperature regulator characterized by a light detector to control the faucet normally for convenience of use and water conservation, and a hand-control for use at times of power failure when the light-detector is not operative so that a desired water supply is available at any time from the faucet. Furthermore, the present invention has a water temperature regulating device which permits supply of water at any desired temperature, or cool or hot water at the user's discretion.

DETAILED DESCRIPTION

Figure 1:
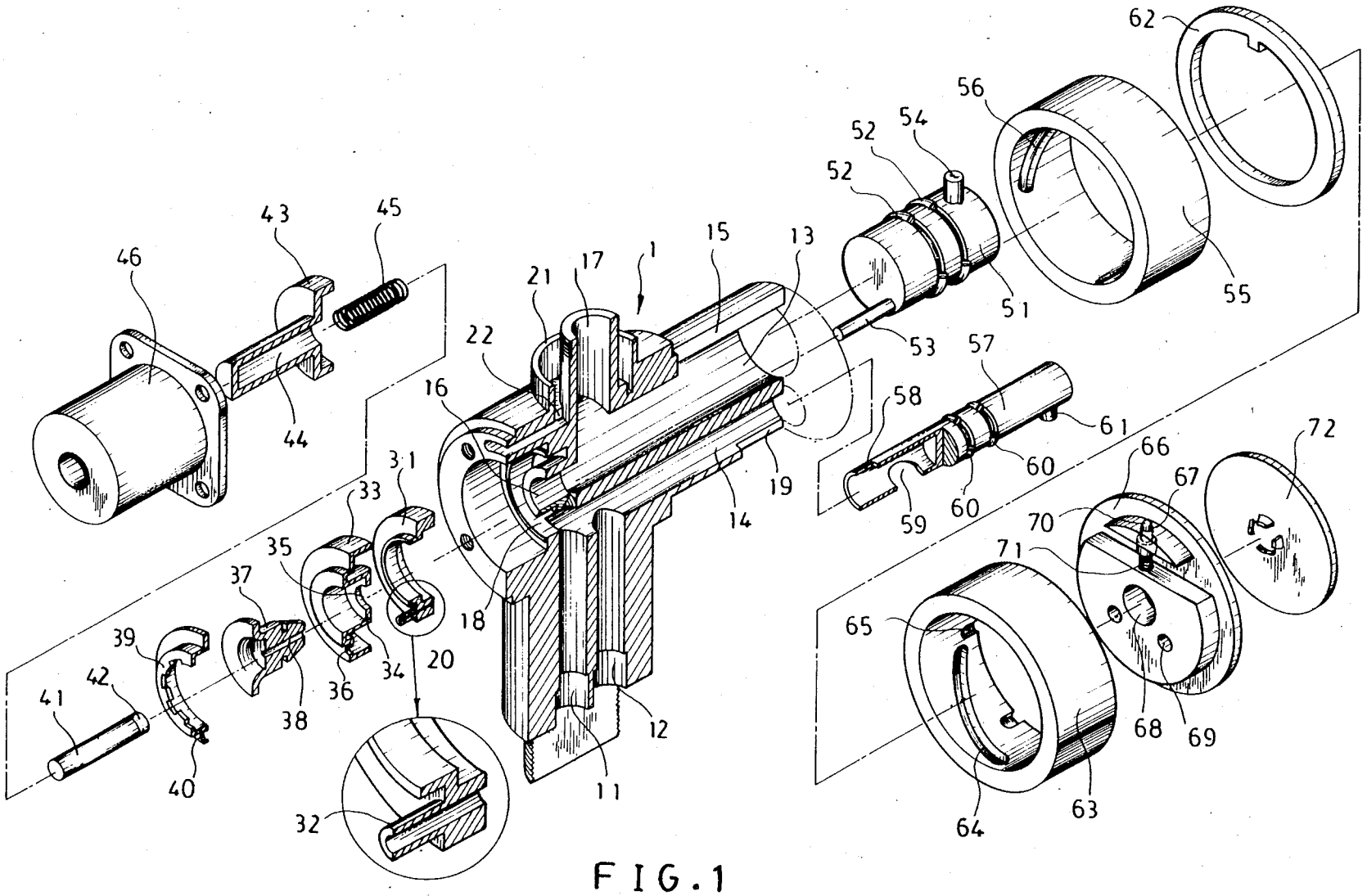
FIG. 1 is a perspective fragmental view of an embodiment according to the present invention.

Referring to FIG. 1, a perspective fragmental view of a preferred embodiment of the present invention, the manifold (1) is a cross-fitting. The lower end of the cross-type fitting (1) is connected to a hot water pipe (11) and a cool or cold water pipe (12). The horizontal transverse section includes a tubular portion (13), and a parallel tubular water temperature control section (14).

The portion (13) includes a selector slot (15) i.e. the long openings at the top, a valve hole (16) which has a diameter which is smaller than that of the tubular portion (13) at the bottom, and a water outlet (17) communicating with the end of the tubular portion (13). The water temperature control section (14) has an end communicating directly with the hot water pipe (11) and the cool water pipe (12), with a mixed water outlet (18) located above the hot water pipe (11). In front of the water temperature control section (14), there is a second lower slot selector (19), i.e. the long opening at the bottom. The valve hole (16) is provided by a tubular projection with a surface in the form of a step surrounded by a circular valve opening (20). The water outlet (17) is surrounded by a circular pipe coupling (21). An electric wire conduit (22) extends from the space between the coupling (21) and the water outlet (17) to a lateral end surface of the transverse section of the manifold (1).

The tie ring (31) is a circular ring with a circular protuberance around its center and a tubular water pressure pipe (32) at its peripheral surface.

The valve element (33) is a soft and elastic sleeve with an outer diameter such that it just fits at the inner wall of the valve opening (20), a shoulder at an extension of the peripheral surface, and a valve cover (34) having an outer diameter just equal to the valve hole (16). The valve sleeve (33) also includes a connection hole (35) at the center, and a hole (36) at the shoulder of the valve sleeve (33) for communicating with the water pressure pipe (32) at the ring (31).

The valve extender (37) has a conical head, a neck having an outer diameter to just fit the connecting hole (35), a cylindrical portion, a disk-like recess at the bottom, and a long tubular water pressure balance passage or pipe (38) extending along its center.

The connection element (39) is a ring-like cover with a stop hole (40) communicating with the water pressure pipe (32).

The metallic extending pin (41) has magnetic properties and is connected to a soft, elastic, and short cylindrical stop head (42) at one end.

The extending pin stop head (43) is in the form of a disc with a tubular extension called the extending pin container (44), for containing the extending pin (41) and a compression spring (45). The extending pin stop head (43) is placed within an induction coil (46). The valve control post (51) is in the form of a cylinder corresponding in diameter to the tubular valve control portion (13) and has two leak-proof rings (52) in the middle, an axial pin (53) aligned with the center of the valve hole (16) at its front end, and a short radially directed, cylindrical, selector pin (54) adapted to be disposed in the selector slot (15).

The valve control ring (55) is a ring with a first groove (56) at its inner wall for receiving the selector pin (54).

The water temperature control post (57) is a cylinder corresponding in diameter to the water temperature control section (14) and has a hollow rear tubular section, a water outlet (58) at the rear end, and a water inlet (59) in the middle of the hollow rear tubular section at a position where the distance between it and the end of the water temperature control post (57) is just equal to the distance between the cool water pipe (12) to the bottom of the water temperature control section (14). The water temperature control post (57) has two leak-proof rings (60) in the middle, and beneath its front end it has a short cylindrical duct (61) corresponding in diameter to the width of the second selector slot (19).

The ring (62) has a block at its inner circumference adapted to engage in the selector slot (15).

The temperature control ring (63) has an oblique groove (64) at its inner wall adapted to receive the cylindrical duct (61) and along its inner wall it has a plurality of openings (65).

The temperature setting element (66) is a circular disk with a rectangular opening having a pin hole (67) at a block above the opening, a round hole (68) at the center, two screw holes (69) below the hole (68), and a temperature setting pin (70) corresponding in diameter to the pin hole (67) on the block, and a compression spring (71) beneath the block.

The cover (72) is in the form of a disk with four equidistant blocks or retainer pieces around its center at one side.

Figure 2:
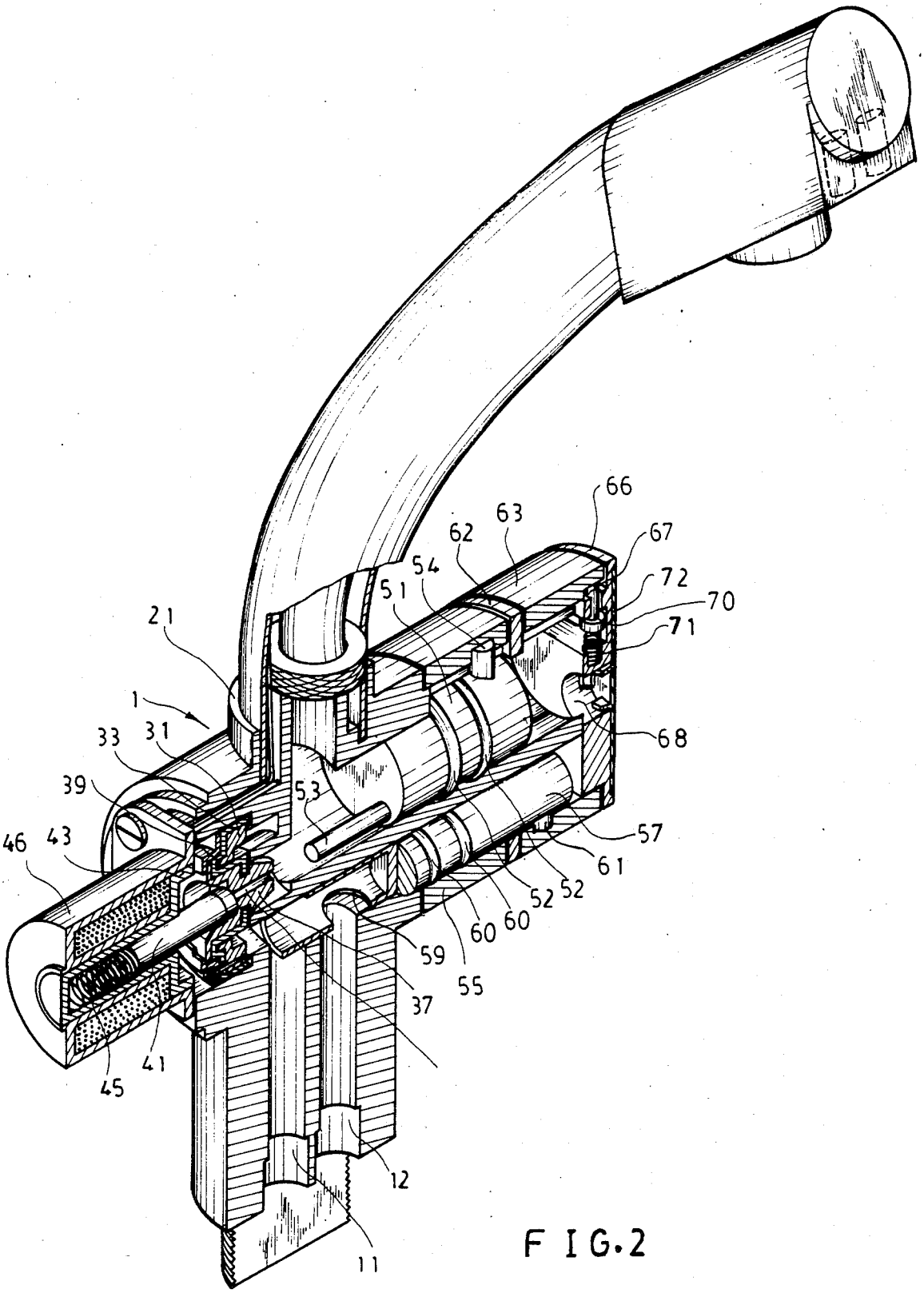
FIG. 2 is a perspective view of an assembly of the embodiment according to the present invention.

With reference to FIG. 2, a perspective view of the embodiment, for assembly of the present invention, the valve extender (37) is inserted into the connecting hole (35) of the valve sleeve (33). Then, the tie ring (31) and the connection cover (33) are connected to the valve sleeve (33) at the respective side so that the water pressure pipe (32) is passing through the hole (36) and the stop hole (40), and is fixed in the stop hole (40) to form a valve.

The said valve is then placed in the valve opening (20), the valve cover (34) is then fixed to the valve hole (16) to provide a shut-off valve.

The extending pin (41) and the compressing spring (45) are placed in the extending pin container (44), and then the extending pin stop head (43) is placed within the induction coil (46) which is fixed to the manifold (1) by screws. Then, the soft and flexible stop head (42) at the front end of the extending pin (41) is pushing against the water pressure balance passage (38) at the center of the valve extender (37).

The valve control post (51) is installed at the valve control section (13) and lead-proofing is achieved by its leak-proof rings (52). After connecting the groove (56) in the valve control ring (55) and the selector pin (54), the valve control post (51) is pushes forward so that the selector pin (54) is located within the selector slot (15) and the valve control ring (55) is connected to the manifold (1). The ring (62) is then placed beside the valve control ring (55).

The groove (64) in the temperature control ring (63) is first connected to the selector (61), and then the water temperature control post (57) is placed in the water temperature control element (14) so that the cylindrical duct (61) is matching with the lower selector slot (19). After moving the water temperature control post (57) to the end of the water temperature control section (14), the water inlet (59) at the water temperature control post (57) is just aligning with the cool water pipe (12) to completely seal the hot water pipe (11).

The temperature setting pin (70) is inserted in the pin hole (67) in the manner that the compression spring (71) is acting against the temperature setting pin (70). Then, the temperature setting disk (66) is fixed to the manifold (1) with screws (not shown), and the cover (72) is fixed against the hole (68) on the temperature setting disk (66).

Figure 3B:
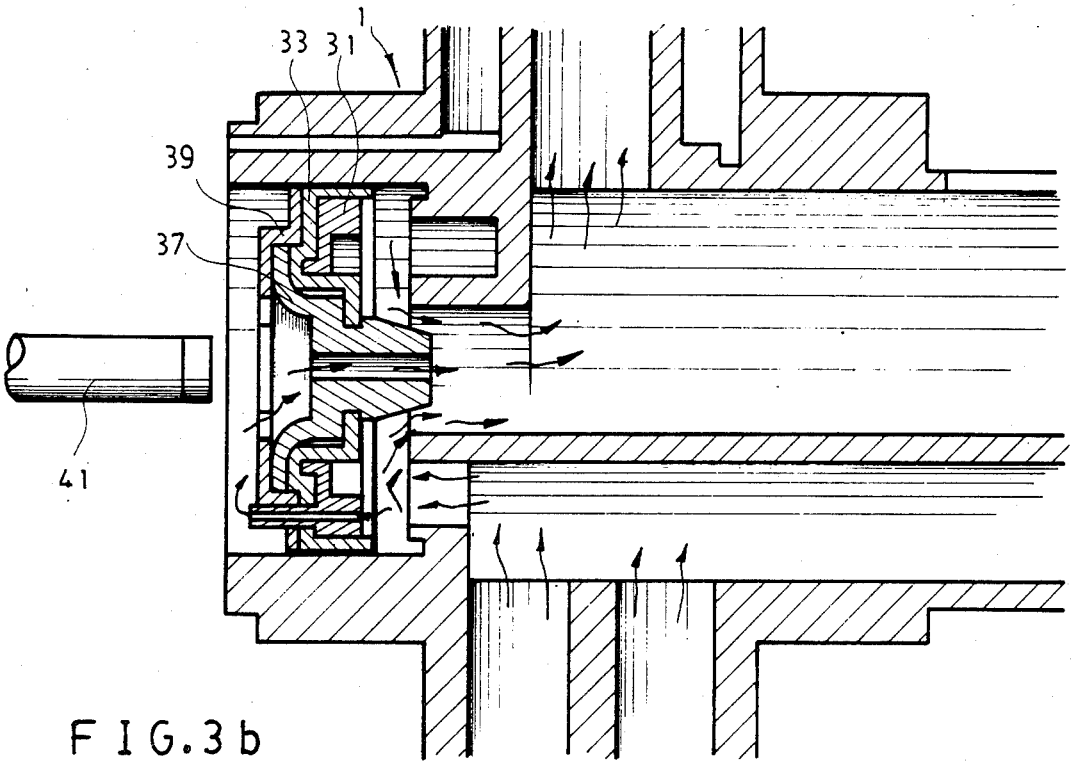
FIGS. 3A–D illustrates in several views the action of the faucet according to the present invention.
Figure 3A:
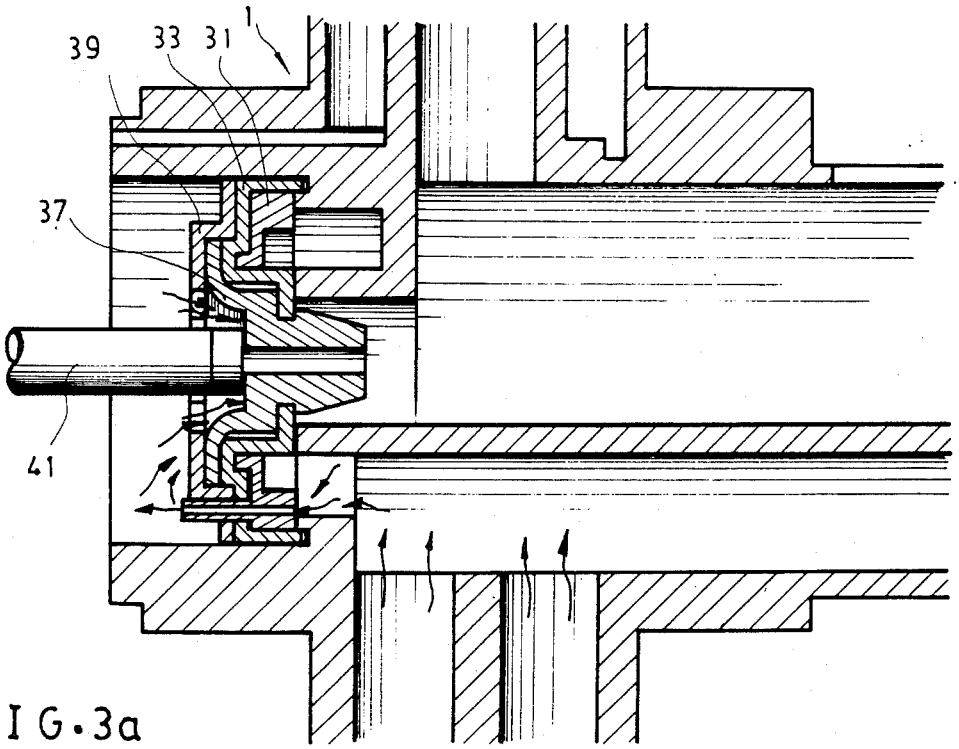

For the application with use of the light-detector, please refer to FIGS. 2 and 3A–B, which illustrate the action of the valve according to the present invention. FIG. 3-A shows the condition where the valve is not in use. As water pressure exists on the back of the water pressure balance passage (38), the valve cover (34) closes the valve hole (16) to prevent water from flowing out through the water outlet (18) and valve hole (16). Whenever articles or hands are going to be washed beneath the valve, the detector (73) detects and sends a signal to the induction coil (46) so that a magnetic force exists to attract the extending pin (41) to move backwards, (FIG. 3-B), then the stop head (42) on the extending pin (41) is disengaged from the water pressure balance passage (38), so that the pressure on the valve extender (37) disappears, and, due to opening of the water pressure balance passage (38), the water pressure at the water outlet (18) is greater than that at the back of the valve extender, so that the valve is opened and water flows out through the water outlet (18) and the valve hole (16).

When the articles or hands are moved out of the detection scope of the detector (73), as shown in FIG. 3-A, the stop head (42) is again acting against the water pressure balance passage (38), and water is no longer able to flow out through the water pressure balance passage (38) and the valve hole (16). Instead water enters into the rear of the valve extender (37) through the water pressure pipe (32), with the increasing pressure following the flowing in of water until the pressure on the back of the valve extender (37) is greater than that at the valve hole (16), so that the soft valve cover (34) is moved by the valve extender (37) to close the valve hole (16) so that no more water will flow out from the valve.

Figure 3C:
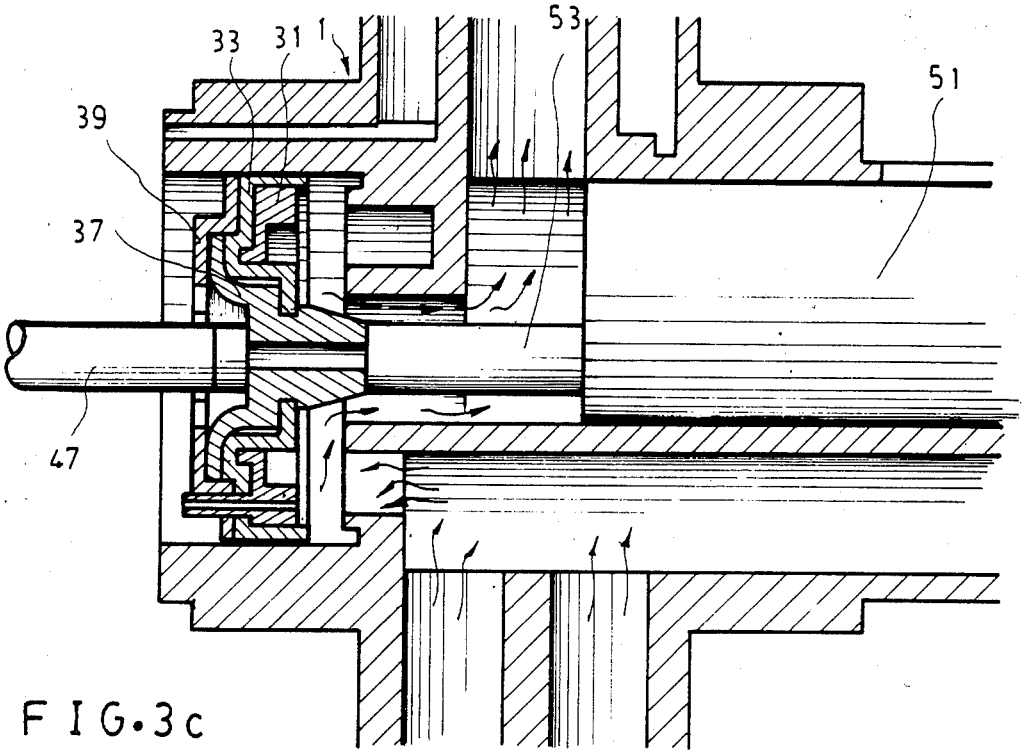
Figure 3D:
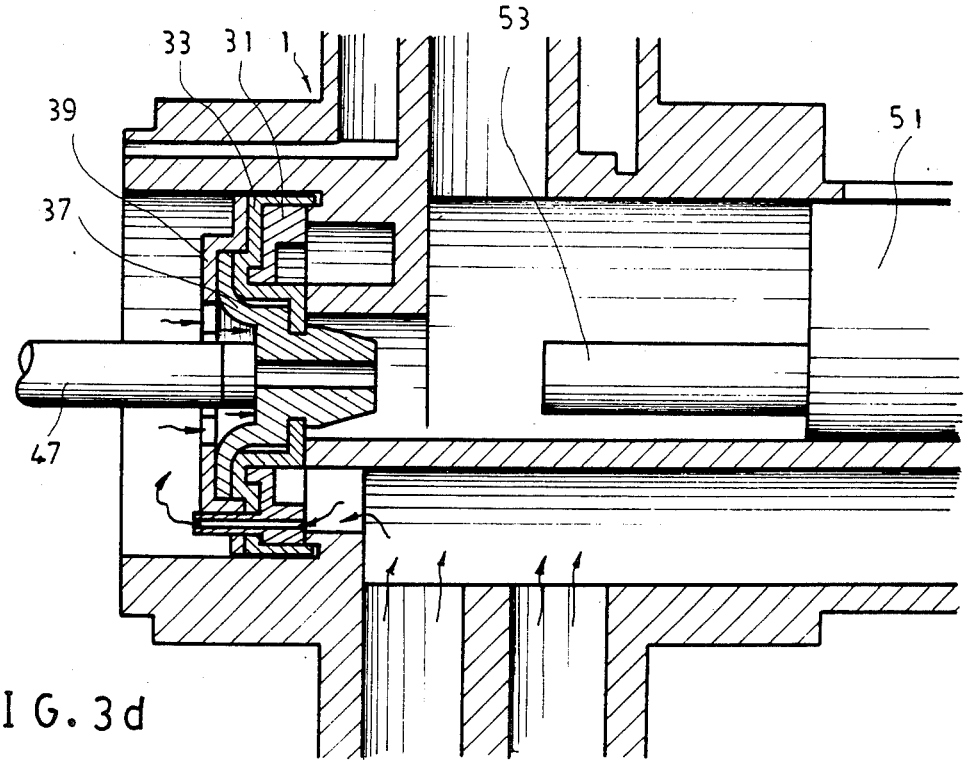

The above action can exists only when there is a power supply acting on the coil. At the condition of a power failure, water does not flow since the valve cover (34) is closing the valve hole (16), but by turning the valve control ring (55), the groove (56) can cause the valve control post (51) to move forward, and the pin (53) will then push the valve extender (37) backwards as shown in FIG. 3C so that the soft valve cover (34) is not covering the valve hole (16) consequently, water flows out through the water outlet (18) and the valve hole (16).

For stopping water flow, as indicated in FIG. 3-D, the valve control ring (55) is turned in reverse direction to move the pin (53) away from the valve extender (37). Then, part of the water flow will enter towards the back of the valve extender (37), via the water pressure pipe (32), and the stop head (42) will act against the water pressure balance passage (38). The pressure increases following increase of water flow, and the valve extender (37) will push the soft valve cover (34) to close the valve hole (16) when the water pressure on the back of the valve extender (37) is greater than that on the water outlet (18), in order to stop water supply.

Rotation of the temperature control ring (63) can cause the water temperature control post (57) to move forwards or backwards in a horizontal level. Since the water inlet (59) on the water temperature control post (57) can match with the cool water pipe (12) to various degrees, and the base of the water temperature control post (57) can regulate the water outlet volume from the hot water pipe (11), a desired water temperature can be obtained by mixing cool and hot water at a suitable proportion.

In case the water temperature control post (57) has been sufficiently shifted in the water temperature control slot (14), the hot water pipe (11) is completely closed, but the cool water pipe (12) is fully matching with the water inlet (59) on the water temperature control post (57) so that only cool water is flowing out from the valve.

In case the water temperature control post (57) has been moved fully in the opposite direction, the water inlet (59) on the water temperature control post (57) is entirely clear of the cool water pipe (12), so that the cool water pipe (12) is completely closed. Thus, hot water only is flowing out from the valve.

The opening (65) on the temperature control ring (65), after being stopped by the temperature setting pin (70), indicates a position at which the water temperature control post (57) will account for a certain hot and cool water proportion. Therefore, the present invention can provide hot water, cool water, or water of any desired temperature at the user's discretion by referring to the position of control ring (65).

In conclusion, the present invention can operate with and without power supply. It provides a water supply at times of power failure, and the detector is operative with a supply of power for convenience purpose. The present invention permits mixing cool and hot water, and water at any desired temperature at the user's discretion. Indeed, it combines the merits of detector controlled and hand controlled faucets, but eliminates defects of both.

I claim:

1. A light-detector, hand-controlled faucet with water temperature regulator comprising in combination:

(a) a cross-type manifold having an end which can be connected to a source of water, said source including a pipe for supplying hot water and a pipe for supplying cool water;

said manifold also having a tubular transverse portion for mounting in it a respective cylindrical valve control post, said tubular transverse portion including a first walled selector slot, said tubular transverse portion including a water outlet, and said water outlet including a circular pipe coupling, and said tubular transverse portion including a valve aperture including a tubular projection and a circular, walled valve-connecting opening;

said manifold having a water temperature control section for mounting in it a respective cylindrical water temperature control post, said water temperature control section having a first end adapted to communicate with the hot water pipe and the cool water pipe, and said water temperature control section including a second walled slot at the end thereof which is opposite from said end adapted to communicate with the hot water pipe and the cool water pipe;

said manifold having a mixed water outlet positioned in communication at the hot water pipe; and said manifold having an electric wire conduit extending from the space between said circular pipe coupling and said water outlet to the respective lateral end surface near said circular valve-connecting opening of the transverse section of said manifold;

(b) a circular tie ring with a circular protuberance around its center and a tubular water pressure pipe at its peripheral surface, said circular tie ring being adapted to be operatively seated in said circular valve-connecting opening of said manifold;

(c) a pliable valve sleeve, said pliable valve seat being adapted to be operatively seated in said circular valve-connecting opening of said manifold, said pliable valve sleeve having an outer diameter in conformity with the inner wall of said valve-connecting opening of said cross-type manifold, said pliable valve sleeve having a shoulder as extension of its peripheral surface, and said pliable valve sleeve having a valve cover with an outer diameter just equal to that of said valve-connecting opening of said cross-type manifold and with a connection hole at the center of said valve cover, and a hole in said shoulder for communication with said tubular water pressure pipe of said tie ring;

(d) a valve extender adapted to be seated at least in said pliable valve sleeve, said valve extender having a conical head, a neck with an outer diameter in conformity with that of the connecting hole in said shoulder of said pliable valve sleeve, a cylindrical portion, a disc-shaped recess in its bottom, and a tubular water pressure balance duct extending along its center;

(e) an annular connection cover adapted to be seated in said valve-connecting opening of said cross-type manifold, said annular connection cover having a stop hole for communication with said tubular water pressure pipe of said circular tie ring;

(f) a metal extending pin with magnetic properties;

(g) a pliable cylindrical stop head operatively connected at one end of said metal extending pin;

(h) an extending pin container comprising a dish-shaped portion and a tubular extension, for containing said extending pin;

(i) a compression spring, operatively mounted in said tubular extension of said extending pin container;

(j) an induction coil for mounting in it said extending pin container and said compression spring in said induction coil, said induction coil being adapted to be operatively connected to said cross-type manifold;

(k) a cylindrical valve control post which is adapted to operatively disposed in and which corresponds in diameter to said tubular transverse portion of said cross-type manifold, said cylindrical valve control post having two leak-proof rings mounted at its central portion, said cylindrical valve control post having at its front end a pin adapted to be aligned with the center of said valve aperture in said tubular transverse portion of said cross-type manifold, and said cylindrical valve control post having a cylindrical selector element corresponding in size to said first selector slot in said tubular transverse portion of said cross-type manifold;

(l) a valve control ring having a first groove at its inner wall for cooperating with said cylindrical selector element of said cylindrical valve control post;

(m) a cylindrical water temperature control post adapted to be operatively mounted in and having a diameter in conformity with said water temperature control section in said cross-type manifold, said control post having a hollow rear tubular section, a water outlet at said rear end, and a water inlet in the central portion of said hollow rear tubular section at a position in conformity with the cool water pipe, said cylindrical water temperature control post having two leak-proof rings mounted at its central portion, and said cylindrical water temperature control post having beneath its forward end a cylindrical selector duct corresponding in size to said second selector slot of said water temperature control section of said cross-type manifold;

(n) a ring with a projecting block at its inner circumference corresponding to said first selector slot for cooperating therewith;

(o) a temperature control ring having an oblique groove in its inner wall for cooperating with and corresponding in size to said second walled slot of said water temperature control section of said cross-type manifold, and said temperature control ring also having a plurality of openings along its inner wall;

(p) a circular temperature setting disc adapted to be connected at said temperature control ring and having a mounting block, at least one rectangular opening, and a pin hole in said block above said opening, and said temperature setting disc having a central round hole, and two screw holes below said central hole;

(q) a temperature setting pin adapted to be mounted in and corresponding in diameter to said pin hole in said block of said temperature setting disc;

(r) a compression spring for said circular temperature setting disc and adapted to be positioned beneath said block of said circular temperature setting disc;

(s) a disc-shaped cover having four equidistant retainer blocks arranged about at one side about its center;

wherein said valve extender neck is inserted in said pliable valve sleeve, and clamped by said circular tie ring at one side and said annular connection cover at the other side, with said water pressure pipe of said circular tie ring passing through said hole in said shoulder of said pliable valve sleeve and said stop hole of said annular connection cover, and said valve extender neck is fixed in said stop hole of said annular connection cover;

wherein said selector element of said cylindrical valve control post is located within said first groove in said valve control ring, with said valve control post and said valve control ring being connected to said cross-type manifold in such a way that said cylindrical selector element is cooperatingly mounted in said first selector slot, and said pin of said valve control post is positioned at the center of said valve aperture of said transverse portion of said cross-type manifold;

wherein said cylindrical selector duct of said cylindrical water temperature control post is located within said oblique groove of said temperature control ring in such a way that said cylindrical selector duct is operatively disposed in said second selector slot of said water temperature control section of said cross-type manifold, for regulating outgoing water temperature by selectively matching said water inlet of said cylindrical water temperature control post with the cool and hot water pipes, and permitting flowing of cool and hot water alone;

wherein said valve control ring cooperatingly engages said water temperature control post, and said valve control ring is operatively connected on said cross-type manifold;

wherein the valve composed of said valve extender, said pliable valve sleeve, said annular connection cover, and said circular tie ring, is operatively connected to the valve-connecting opening of said cross-type manifold; and wherein said induction coil is secured at said cross-type manifold in such a way that said metal extending pin is operatively actuating with respect to said water pressure balance duct of said valve extender.

2. The faucet as defined in claim 1 wherein said valve aperture is smaller in diameter than said tubular transverse portion of said cross-type manifold.

3. The faucet as defined in claim 1 wherein said cylindrical selector element of said cylindrical valve control post is a short cylindrical selector.

4. The faucet as defined in claim 1 wherein said temperature setting disc includes at least one opening for said temperature setting pin for selectively setting outgoing water temperature.

5. The faucet as defined in claim 1 wherein said induction coil is secured at said cross-type manifold by screws.

* * * * *